United States Patent [19]

Manning

[11] 4,290,638

[45] Sep. 22, 1981

[54] APPARATUS FOR RELEASABLE CONNECTION TO AN EMBEDDED MEMBER

[75] Inventor: Lindley Manning, Reno, Nev.

[73] Assignee: Superior Concrete Accessories, Inc., San Diego, Calif.

[21] Appl. No.: 85,913

[22] Filed: Oct. 17, 1979

[51] Int. Cl.[3] ..... B66C 1/66

[52] U.S. Cl. ..... 294/89; 52/125; 52/707; 294/95

[58] Field of Search ..... 294/83 R, 86 R, 86.24, 294/86.25, 89, 93–95, 97, 116; 52/125, 699, 701–704, 706, 707; 85/3 R, 3 S, 67

[56] References Cited

U.S. PATENT DOCUMENTS

| | | | |
|---|---|---|---|
| 1,671,429 | 5/1928 | Janney | 294/95 X |
| 2,261,393 | 11/1941 | Kothny | 294/86.24 X |
| 3,284,125 | 11/1966 | Blaske et al. | 294/89 X |
| 3,431,012 | 3/1969 | Courtois et al. | 294/86 R |
| 4,017,115 | 4/1977 | Holt et al. | 294/89 |
| 4,068,879 | 1/1978 | Torbet et al. | 294/89 |
| 4,123,882 | 11/1978 | Case et al. | 294/89 X |
| 4,204,711 | 5/1980 | Lancelot et al. | 294/89 |

*Primary Examiner*—Johnny D. Cherry
*Attorney, Agent, or Firm*—Gerlach, O'Brien & Kleinke

[57] ABSTRACT

Apparatus such as a pickup unit for releasable connection to a member such as an anchor insert embedded in an object such as a concrete body, of the type including a housing forming part of the apparatus and which is inserted into the object adjacent to the member, lugs movably mounted in the housing for releasable engagement with the member, and an actuator movably mounted in the housing for moving the lugs between member-engaging and disengaging dispositions, is provided with sockets in the housing, a lug mounted in each socket for reciprocal rotational movement between such dispositions, the actuator having first reaction surfaces engaging the lugs to prevent them from being rotated under load, and a seat for each lug forming a part of the socket structure and providing a second reaction surface for transferring to the housing load forces exerted on the lug by the member. Preferably, the socket structure additionally includes a third reaction surface facing oppositely to each second reaction surface, and the third reaction surfaces also act to prevent the lugs from being rotated under load.

22 Claims, 28 Drawing Figures

APPARATUS FOR RELEASABLE CONNECTION TO AN EMBEDDED MEMBER

BACKGROUND OF THE INVENTION

This invention relates to apparatus for releasable connection to a member embedded in an object adjacent to a cavity which provides access to the member and communicates with an opening in an external surface of the object, and to a combination of the apparatus and member.

In the past, various types of apparatus have been employed in combination with members which are embedded in objects and to which the apparatus may be connected for the purpose of lifting the objects, such as by lifting or hoisting mechanism attached to the apparatus. After a lifting operation, the apparatus is disconnected from the member, which remains embedded in the object.

A specific combination embodies a pickup unit and an anchor insert, the latter being embedded in a concrete body and the former being releasably or detachably connected thereto for the purpose of lifting the body. U.S. Pat. Nos. 3,431,012 to Courtois et al. and 4,018,470 to Tye, among others, disclose such pickup units and inserts, and the structures disclosed have been in extensive commercial use, where they have been employed safely and effectively in the tilt-up erection of large and heavy concrete slabs which are incorporated into building structures as wall panels. The anchor inserts employed in the foregoing combinations have been constructed employing anchor rods or anchor rod sections as the parts of the inserts serving to transfer the weight loads of the concrete slabs to the pickup units, which in turn transfer the loads to lifting apparatus. The pickup units of the patents employ a locking stem having a T-head at its inner end. The stem of a pickup unit is engaged with or connected to the spaced anchor rods of an insert by inserting the T-head between them, and rotating the stem through an angle of 90°, to place lifting surfaces on the T-head beneath thrust surfaces on the anchor rods for interengaging the two. Following a lifting operation, the locking stem is rotated 90°, to release the stem from engagement with the anchor rods, after which the entire pickup unit may be removed from the slab.

Recently, pickup units having stem-like housings in which laterally slidable lifting lugs are mounted, have been employed with inserts embedded in concrete slabs and engaged by the lugs for lifting the slabs. The lugs are moved laterally into and out of engagement with the inserts by operation of an actuator movable longitudinally in the housing. An advantage of the structures is that the pickup units may be removed from erected slabs merely by exerting an outward pull on the actuators, to move them longitudinally, and the pull may be exerted by an operator at a remote point on the ground, acting through the medium of a lanyard or a lever. Such pickup units and anchor inserts are disclosed in my U.S. Pat. No. 4,123,882 with James E. Case and Richard L. Ruppert, and in U.S. Pat. No. 4,017,115.

A pickup unit having lifting lugs which rotate reciprocally between engagement and disengagement positions with respect to a conical insert in a concrete body is disclosed in U.S. Pat. No. 4,068,879. The lugs are supported by pivot pins, which, therefore, must bear the entire weight load as it is transferred to the lifting mechanism, placing the pins under high shear stress. Apparatus embodying a pickup unit having rotatable lugs for lifting containers or vessels is disclosed in U.S. Pat. No. 3,284,125. In this structure, a pivot pin is relied upon to resist the torque to which the lugs are subjected by the weight of the load acting at the extremities of the lugs, thereby placing the pin under shear stress. A releasable fastening means employing rotatable load-engaging lugs which, similarly, place pivot pins under shear stress is disclosed in U.S. Pat. No. 3,534,650.

SUMMARY OF THE INVENTION

The invention provides apparatus including lugs rotatable in a housing, for releasable connection to an embedded member, which apparatus has a high, safe load-carrying capacity, and is rugged and compact. The lugs are seated on the housing for transferring the weight load to the housing. There is no support of the weight load by lug pivots pins or the like, the need for which type of support is obviated. The torque load acting on each lug is resisted by an actuator surface in engagement with the lug, and in the preferred embodiment, also by a housing surface in engagement with the lug. Preferably, no torque load is carried by a pivot pin or the like, although a minor proportion of the torque load may be taken by such a pin if desired.

More particularly, the invention provides an improvement in apparatus for releasable connection to a member embedded in an object adjacent to a cavity which provides access to the member and communicates with an opening in an external surface of the object, such member having a plurality of lug-engagement surfaces disposed in angularly spaced relation about the cavity and each facing in a direction away from the external surface, such improvement comprising: a housing having an inner end portion and an outer end portion and extending longitudinally therebetween, the housing being adapted for insertion of its inner end portion through the opening and into the cavity, means defining a longitudinal bore in the housing, means defining a plurality of lug-mounting sockets in the inner end portion, each of the sockets communicating with the bore laterally inwardly of the socket and having a laterally outer mouth disposed to face an adjacent one of the lug-engagement surfaces when the housing inner end portion is in the cavity, a lug mounted in each of the sockets for reciprocal rotational movement therein between a first disposition wherein a portion of the lug protrudes laterally through the mouth of the socket into engagement with the adjacent lug-engagement surface to connect the apparatus to the member, and a second disposition wherein the lug portion is withdrawn from such engagement to release the apparatus from the member, actuating means longitudinally movably mounted in the bore for reciprocation between first and second positions to engage the lugs and rotate them correspondingly between their first and second dispositions, the actuating means having first reaction surfaces disposed when in the first position between the lugs in engagement therewith and thereby providing resistance acting to prevent the lugs from being rotated out of their first dispositions by load forces exerted on the lug by the member, and seating means for each lug included in the socket-defining means and providing a second reaction surface facing in a direction toward the external surface of the object and engaging the lug for transferring to the housing load forces exerted on the lug by the member.

In the preferred embodiments of the invention, the socket-defining means additionally includes a third reaction surface facing oppositely to the second reaction surface in each socket and engaging the lug mounted in the socket, the third reaction surfaces providing additional resistance acting to prevent the lugs from being rotated out of their first dispositions by load forces exerted on the lugs by the member.

The invention is especially well suited for incorporation in a pickup unit for releasable connection to an anchor insert constructed with anchor rods and embedded in a concrete body, such as disclosed in the above-described Courtois et al. and Tye patents. For this purpose, it is preferred that each lug have an arcuate surface for engagement with a complementary arcuate engagement surface on an anchor rod having a round cross section.

The invention further provides a novel combination of surfaces on the lugs and on the actuating means, which cooperate to produce rotational movement of the lugs between their first and second dispositions, prevent the lugs from being rotated out of their first dispositions under load, and limit the rotation of the lugs in their second disposition by abutment on each other.

BRIEF DESCRIPTION OF THE DRAWINGS

The attached drawings illustrate a preferred embodiment of the combination of an anchor insert and a pickup unit according to the invention, without limitation thereto. In the drawings, like elements are identified by like reference symbols in each of the views, and.

DESCRIPTION OF THE PREFERRED EMBODIMENT

Figure 1:
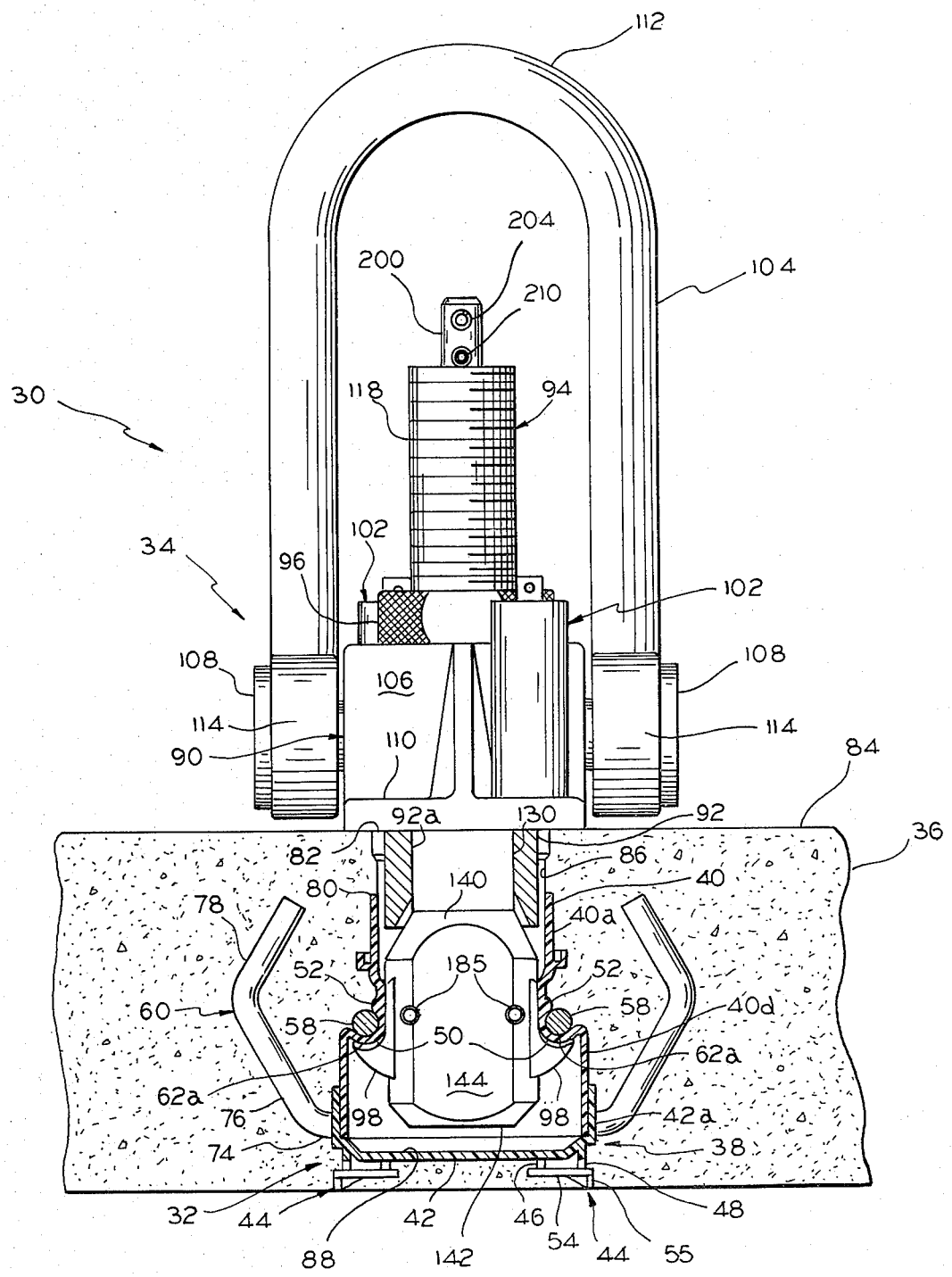
FIG. 1 is a partly side elevational and partly vertical sectional view of a lifting apparatus including an assembly of a pickup unit engaging an anchor insert according to the invention, the anchor insert being embedded in a concrete slab disposed horizontally.

Referring to FIGS. 1–4 of the drawings, lifting apparatus 30 includes an anchor insert 32 and a pickup unit 34, constructed for releasable interconnection. The anchor insert 32 is illustrated as being embedded in a horizontally disposed concrete slab 36, which was formed by casting in a horizontal concrete form (not shown) having a plurality of anchor inserts arranged within the form, in accordance with conventional practice. The slab 36 is intended to be lifted into a vertically extending position, where it becomes a wall panel or the like in a building into which it is integrated. The slab 36 is lifted by means of lifting or hoisting mechanism connected to the pickup unit 34. When the slab 36 has been raised and braced, the pickup unit 34 is disconnected from the anchor insert 32, after which the insert remains embedded in the wall panel, and the pickup unit is used repeatedly with inserts in other slabs or concrete bodies of other types.

The anchor insert 32 is similar to prior inserts of the type illustrated in the aforementioned Tye patent, and it is typical of inserts with which the pickup unit 34 preferably is employed, in accordance with the invention. The insert 32 includes a two-piece concrete-excluding cage or can 38, which is a unitary structure of a hollow single-walled body or tube 40, a base or inner or bottom end closure 42, and supporting feet 44 connected to the base 42 integrally by inside and outside struts or flanges 46 and 48, respectively. The components of the cage 38 preferably are molded of plastic material, such as polystyrene.

The cage body 40 includes a generally cylindrical outer or upper (as disposed in a horizontal slab 36 or a form therefor) portion **40*a*, and an intermediate throat portion having laterally inwardly and downwardly tapering intermediate side portions 40*b* (FIGS. 2 and 3), which form an intermediate oblong opening 40*c* (FIG. 3) in the body 40, leading to a generally rectangular inner or lower portion 40*d*. The inner portion 40*d* is enlarged with respect to the throat portion, and a pair of spaced apart shoulders 50 extend laterally between and are integral with the portions, The base 42 includes a generally rectangular upstanding wall 42*a*, which telescopically receives the rectangular inner portion 40*d* of the body 40 in a snug or friction fit. The joint between the body 40 and the base 42** may be sealed by a sealing and/or adhesive composition, or in the case of plastic parts, by solvent welding or fusion. In any case, a mortar-tight joint is produced.

Figure 2:
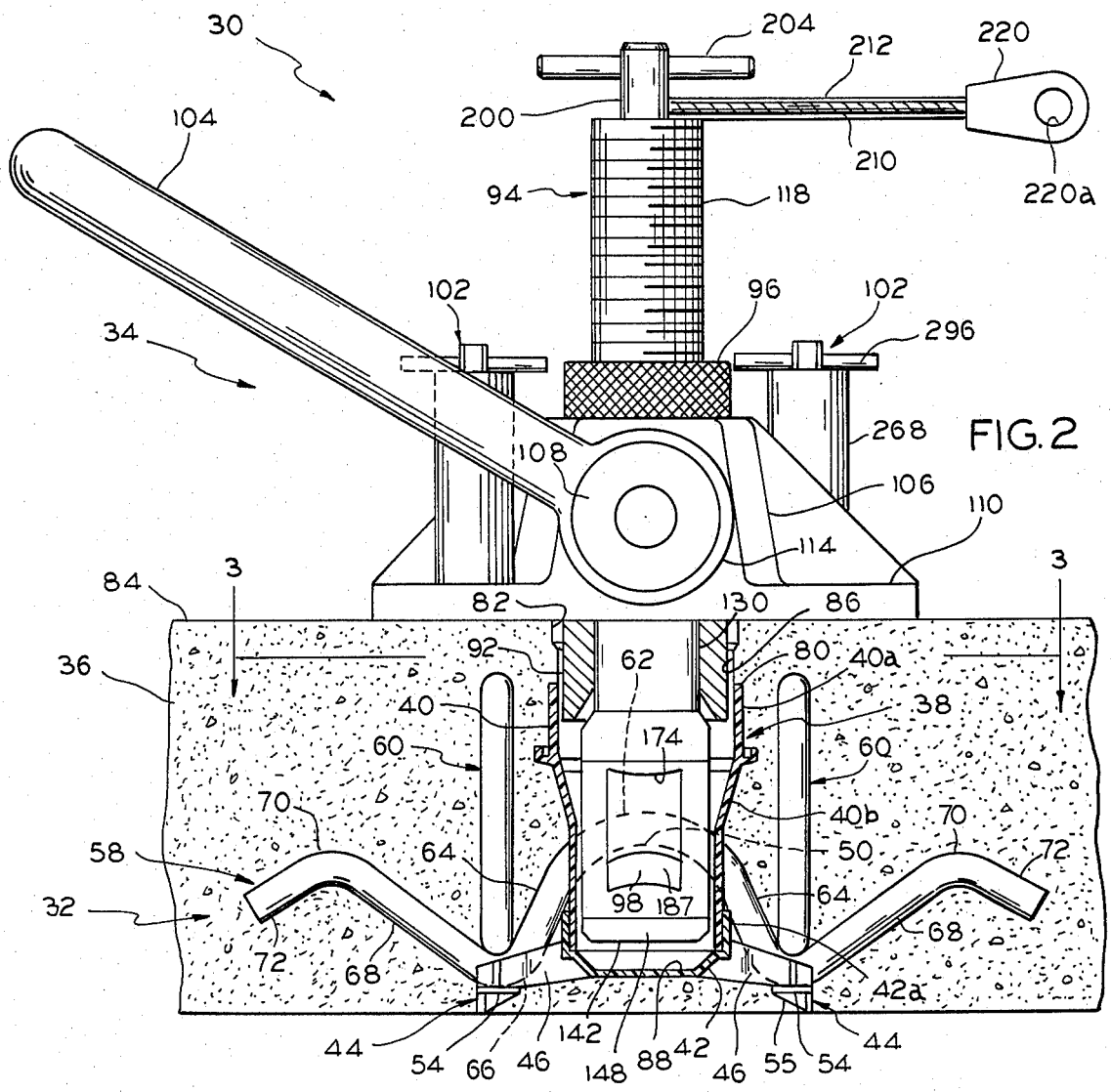
FIG. 2 is a partly side elevational and partly vertical sectional view of the lifting apparatus, as viewed at an angle of 90° to the view of FIG. 1.
Figure 3:
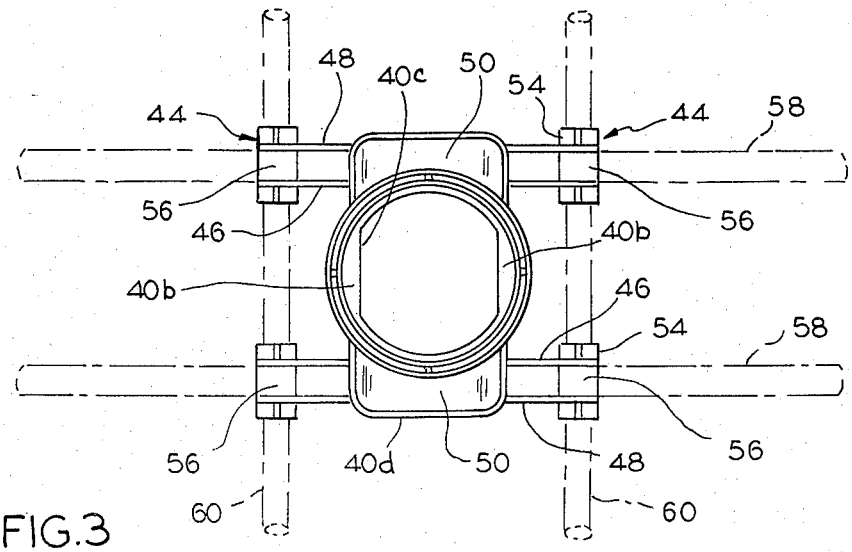
FIG. 3 is a top plan view of the cage or can component of the anchor insert, as viewed substantially on line 3—3 of FIG. 2.
Figure 4:
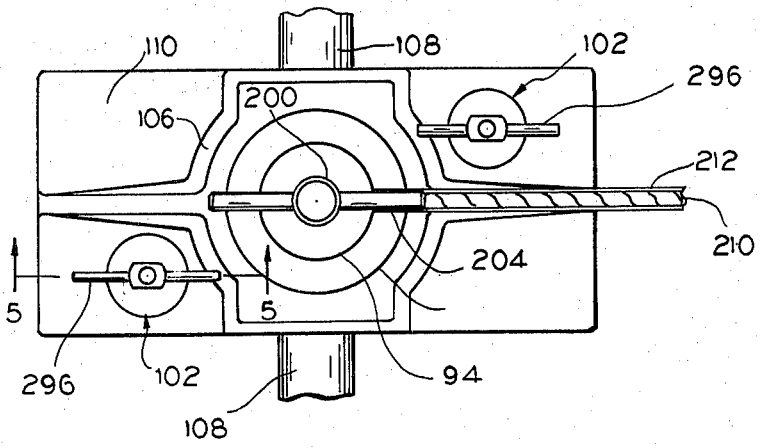
FIG. 4 is a partial top plan view of the pickup unit, omitting the bail thereof.

The shoulders 50 lie in parallel vertical planes, and they are spaced longitudinally outwardly or upwardly from the bottom of the base 42. The shoulders 50 are curved or rounded across their width, convexly downwardly, as seen in FIG. 1. The shoulders 50 also are curved along their length, convexly upwardly, as seen in FIG. 2. Beads 52 (FIG. 1) are formed in the body 40 in spaced relation above the shoulders 50, and they extend laterally outwardly from the body, for a purpose which is described subsequently. It is to be understood that the uses herein of the terms "upwardly," "downwardly," "horizontal," "vertical," and similar terminology have reference to the disposition of the members when the insert 32 is seated on the feet 44 in a concrete form for pouring a horizontal slab, or when embedded in the horizontally disposed slab.

Each of the illustrative feet 44 includes a seating plate 54, which initially is supported horizontally in spaced relation above the floor of a concrete form by pointed rib-like supports 55. A pair of struts 46 and 48 extends upwardly from each seating plate, to form an anchor rod seat or holder 56 therewith. Two spaced parallel primary anchor rods or rod sections 58 are mounted externally on the wall of the cage 38 on opposite sides thereof, being seated on the shoulders 50 and in the seats 56. Two spaced parallel secondary anchor rods or rod sections 60 are fixedly secured to the primary anchor rods 58, on opposite ones of the remaining sides of the cage 38.

The anchor rods 58 and 60 are smooth bent cylindrically round rods or heavy wires. The primary rods 58 provide the principal support for a concrete slab which is to be lifted, and the secondary rods 60 provide a relatively small, minor proportion of the support for the slab. The primary rods 58 are identical, and each is a sinuous member which includes a central portion 62 curving downwardly, when installed, substantially on the arc of a circle, a transition portion 64 extending downwardly and outwardly from each of the opposite ends of the central portion, a first reverse bend portion 66 extending upwardly and outwardly from each transition portion, an upwardly and outwardly inclined extension portion 68 extending from each first reverse bend portion 66, a second reverse bend portion 70 extending from each extension portion, and a downwardly and outwardly inclined terminal portion 72 extending from each second reverse bend portion.

The central portion 62 of each primary anchor rod 58 is received relatively snugly within the concavity of the outer surface of one of the shoulders 50 of the cage 38, and is retained therein by the adjacent bead 52. A lower, lug-engagement or thrust surface **62*a* (FIG. 1) on the central portion 62 faces downwardly, away from the external surface 84 of the slab 36, and is in contact with the upwardly facing outer surface of the shoulder 50. The lug-engagement surface 62*a*** is arcuate in cross section and longitudinally, complementary to the shoulder surface.

The ends of the central portion 62 and the transition portions 64 extend at a relatively small angle from the vertical, which in the illustrative embodiment is about 15°–17°, thereby to cause a large component of the initial lifting force to be exerted in the vertical direction. The first reverse bend portions 66 are received in the seats 56, which serve to locate the primary anchor rods 58 in parallel vertical planes substantially parallel to the vertical or longitudinal axis of the cage 38. The first reverse bend portions 66 are located adjacent to the bottom of the cage 38 and relatively deeply in the slab 36, to provide a maximum thickness of concrete thereabove for absorbing and resisting the load forces. The extension portions 68 extend at angles of about 45°–50° from the vertical, and the terminal portions 72 are approximately perpendicular thereto, in the illustrative embodiment. The primary anchor rods 58 are formed of steel rod or wire stock, which has a diameter of 0.442 inch in the illustrative embodiment. The rod structure is designed to achieve high safe working loads.

The secondary anchor rods 60 are identical, being hexagonally-shaped five-sided members. Each of the secondary rods 60 includes a straight, initially horizontal central portion 74 (FIG. 1), an upwardly and outwardly inclined lower side portion 76 extending from each of the opposite ends of the central portion, and an upwardly and inwardly inclined upper and terminal side portion 78 extending from the outer end of each of the lower side portions 76. The central portions 74 of the secondary rods 60 are affixed to the upper surfaces of the first reverse bend portions 66 of the primary rods 58, preferably by welding, so that the secondary rods 60 extend in initially vertical planes perpendicular to the planes of the primary anchor rods 58. The secondary anchor rods 60 are formed of steel rod or wire stock, and they may have a diameter less than that of the primary rods 58, in view of their relatively small loadcarrying contribution. In the illustrative embodiment, the secondary rods 60 are formed of steel rod or wire stock having a diameter of about 0.340 inch.

When the insert 32 is arranged in a concrete form, the open upper rim or edge 80 of the cage 38 is closed with a suitable closure cap, not illustrated, prior to pouring wet concrete in the form, to prevent concrete from entering the cage and to form an access opening 82 in the outer or upper external surface 84 of the slab 36. This practice is well known, as illustrated in the aforementioned Courtois et al. patent. The concrete is poured in the form to the desired depth, covering the insert 32 and its closure cap in the process. When the concrete has set, access to the interior of the insert cage 38 is afforded by removing the closure cap, to leave the access opening 82. In the illustrative embodiment, a passageway 86 also remains, of varying circular cross section corresponding to the contour of the removed cap. The passageway 86 places the access opening 82 in communication with the open outer end of the cage 38, as circumscribed by the rim 80, and with a cavity 88 defined within the slab 36 by the cage body 40 and base 42, internally thereof.

In this manner, the cage 38 serves to exclude concrete from the connective surfaces of the anchor insert 32, that is, the lug-engagement surfaces **62*a* on the primary anchor rods 58. The cavity 88 provides access to the insert at the lug-engagement surfaces 62*a*, which are separated from the cavity only by relatively thin wall portions formed into the shoulders 50. The feet 44 serve to support the insert 32 in point contact on the floor of the concrete form, with the anchor rods 58 and 60 spaced thereabove, for pouring concrete around the insert and embedding the insert substantially completely in the formed slab 36**.

Referring to FIGS. 1, 2, 4 and 8, in particular, the pickup unit 34 includes a support member 90, a bearing sleeve 92 suspended by the support member, a housing 94 extending through the support member and the bearing sleeve, a lock nut 96 supporting the housing on the support member, a pair of lifting lugs 98 mounted in the housing, an actuator or actuating means 100 extending through the housing, a pair of ejectors 102 mounted on the support member, and a lifting bail 104 connected to the support member.

The support member 90, in general, is a conventional structure of a generally tubular body 106 having a pair of diametrically opposed integral trunnions 108 extending outwardly therefrom, and a substantially flat, rectangular bearing plate 110 integral with the base of the body. The lifting bail 104 having a bight 112 and a pair of terminal eyelets 114 is pivotally secured on the trunnions 108, which project through the eyelets. The ejectors 102 are mounted on the bearing plate 110 adjacent to diagonally opposite corners thereof.

Figure 8:
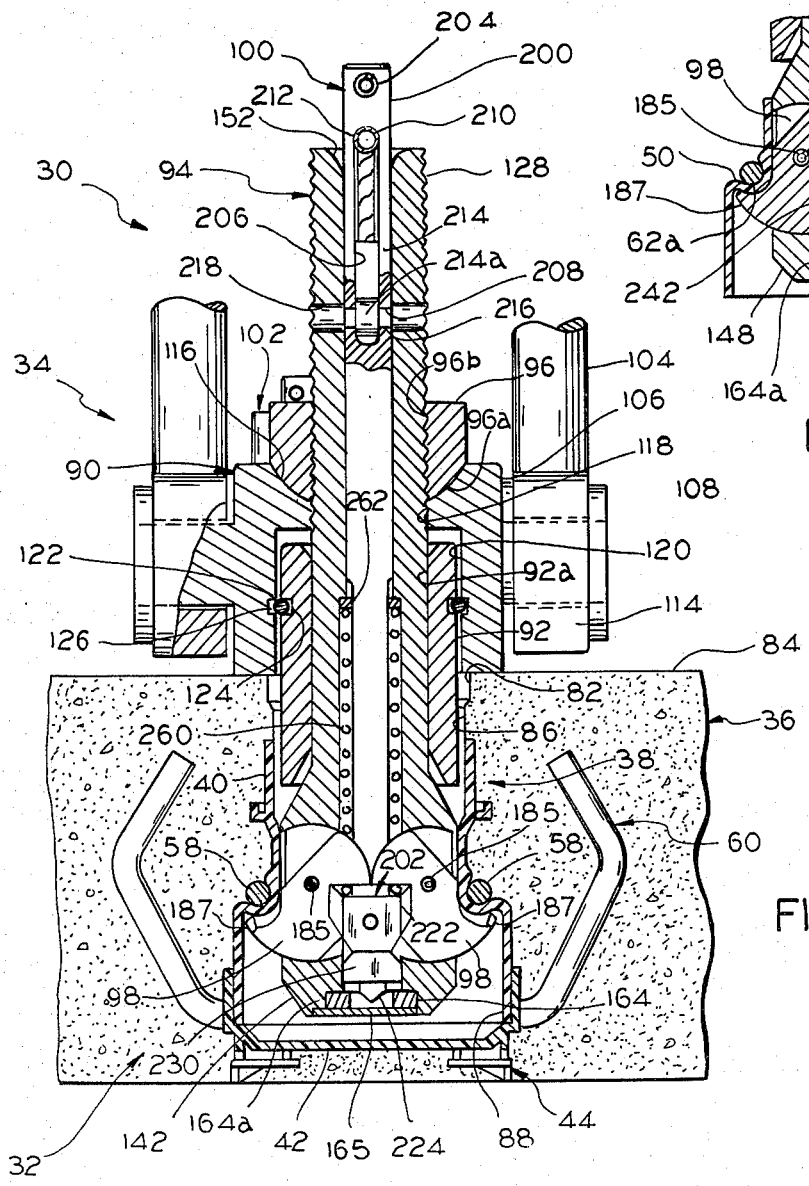
FIG. 8 is a view similar to FIG. 1, with additional parts shown in vertical sectional view and with parts broken away.

As seen in FIG. 8, the body 106 is provided with an arcuate concave seat 116 centrally located adjacent to its upper surface. Successive coaxial cylindrical bores 118 and 120 extend from the seat 116 to the bottom of the support member 90, the lower bore 120 being enlarged with respect to the upper bore 118. The lock nut 96 has an arcuate convex base portion 96*a* complementary to the seat 116, whereby the lock nut may be seated on the latter rotatably and with the ability to rock slightly on the support member 90. The lock nut 96 has an internally threaded opening 96*b*, which registers with the bore 118 in the support member.

The bearing sleeve 92 is an elongated cylindrical tubular member having a bore 92*a* and an outside diameter slightly less than the inside diameter of the lower bore 120 of the support member. The lower bore 120 receives the upper end of the sleeve, while the lower end of the sleeve projects axially downwardly from the support member, out of the lower bore. The sleeve 92 is loosely supported in the lower bore 120, by means of a split expansion ring 122, which is received simultaneously in registering peripheral grooves 124 and 126 in the outer surface of the bearing sleeve 92 and in the wall of the lower bore 120, respectively.

Referring to FIGS. 8, 10 and 14–17, the housing 94 is a one-piece element having integral portions, which include, successively, an outer or upper externally threaded cylindrical mounting portion or end portion 128, an intermediate smooth cylindrical shank portion 130, an intermediate upwardly and inwardly tapering oblong transition portion 140, and an inner or lower enlarged oblong body portion or end portion 142, The body portion 142 is bounded by planar side surfaces 144, which are parallel to each other and to the longitudinal or vertical axis of the housing 94, and by opposed cylindrically rounded side surfaces 146. The bottom of the body portion 142 is peripherally beveled, as indicated at 148.

The housing 94 is inserted through the bearing sleeve 92 and through the body 106 of the support member 90, with a relatively loose sliding fit in the respective bores 92*a* and 118 thereof. The lock nut 96 is threaded on the mounting portion 128 of the housing 94, for vertical adjustment of the housing on the support member 90, longitudinally or axially of the housing. The lock nut 96 is supported on the seat 116 of the support member 90, thereby supporting the housing 94 on the support member for transferring a load thereto.

An axial cylindrical outer bore 150 extends through the mounting portion 128 of the housing 94, into the shank portion 130. An arcuate flaring mouth 152 is provided at the outer end of the outer bore 150. An enlarged axial cylindrical intermediate bore 154 extends from the outer bore 150 to the transition portion 140, where a substantially axial square intermediate bore 156 is provided. The square intermediate bore 156 communicates with a pair of lug-mounting sockets 158, which are oppositely disposed and in communication with each other in the body portion 142. An axially disposed rectangular bore 162 in the housing communicates with the socket bottoms and with a recess 163 in the bottom of the body portion 142. The recess 163 ultimately receives a stop washer 164 and a cylindrical closure plug 165. The stop washer 164 is circular except for a locating flat 164*a* on its outer periphery, and a rectangular hole 164*b* extends centrally through the washer. The stop washer 164 is received first in the recess 163, and the plug 165 is received over the washer, with the recess conforming to the peripheries thereof. The plug 165 is temporarily or permanently secured to the housing body portion 142, such as by a friction fit or by welding.

The sockets 158 are defined by two planar internal side wall surfaces 166 of the body portion 142. The wall surfaces 166 are parallel to each other and to the longitudinal axis of the housing 94, on opposite sides of the axis, and extend completely through the body portion 142 and intersect the rounded sides 146 of the body portion. Each of the sockets 158 is further defined by a concave arcuate top wall surface 168 and a concave arcuate bottom wall surface 170. The bottom wall surfaces 170 face in a direction toward the external surface 84 of the slab 36, and the top wall surfaces 168 face oppositely to the bottom wall surfaces.

A transverse pivot pin opening 172 in the body portion 142 extends through the side wall surfaces 166 in register with each of the sockets 158. The top wall surfaces 168 are curved on one radius from respective pivot pin openings 172, and the bottom wall surfaces 170 are curved on a second, longer radius therefrom, in the illustrative embodiment. The sockets 158 communicate with the housing bores 150, 154, 156 and 162 laterally inwardly of the sockets, and the sockets each have a laterally outer mouth 174 at the intersections of the side, top, and bottom wall surfaces 166, 168 and 170 with the rounded side surfaces 146 of the body portion 142.

Referring to FIGS. 18–22, each lifting lug 98 is a one-piece integral structure which has two parallel planar opposite side surfaces 176, between which the lug is contoured to provide engagement surfaces and cam surfaces. A body portion 178 of each lug is provided with a transverse pivot pin opening 180, the center of which constitutes the rotational axis of the lug. The pin opening 180 is disposed for registry with a pivot pin opening 172 in the housing body portion 142, with the lug received in a socket 158. In generally diagonally opposed relation on the lug body are upper and lower convex arcuate socket wall-engagement surfaces 182 and 184, respectively. The surfaces 182 and 184, respectively, are curved on short and long radii from the pivot pin opening 172, substantially the same as the respective radii of curvature of the socket top and bottom wall surfaces 168 and 170.

The lifting lugs 98 fit closely in the sockets 158, and are mounted for rotational movement therein. Each lug 98 is retained in its socket by a mounting pin 185, in the form of a roll pin which is fixedly mounted in a pin opening 172 in the housing body portion 142, and inserted through the pin opening 180 (FIG. 20) in the lug.

(A "roll pin" as employed in the illustrative structure is C-shaped in cross section. It is fixedly mounted by compression, insertion in an opening, and release for expansion into a tight friction fit.) The mounting pin 185 has a loose fit in the pin opening 180 in the lug, to obviate or prevent any substantial transfer of load forces from the lug to the pin. Each of the lugs 98 is seated in a socket 158 with its lower engagement surface 184 engaging a bottom wall surface 170 of the socket, which latter surface serves as a reaction surface for load transfer thereto. The upper engagement surface 182 on each lug engages a top wall surface 168 of the socket, which latter surface serves as a reaction surface providing resistance to rotation of the lug under load.

A concave rod-engagement surface 186 is formed on an outwardly projecting portion 187 of each lug 98, and it is complementary to the lug-engagement surface 62*a* on each primary anchor rod 58, as well as to the inner surface of the shoulder 50 adjacent to the anchor rod in the insert 32. Thus, the rod-engagement surface 186 is curved generally in the radial direction, on a radius of curvature such as to receive snugly therein a portion of a shoulder 50 bearing a portion of a rod 58. The rod-engagement surface 186 also is convexly curved transversely of the lug, so as to conform to the longitudinal curvatures of the shoulder 50 and the rod 58.

The projecting portion 187 is disposed on a laterally outer side of each lug 98, as mounted. On the laterally inner side of each lug, inwardly of its rotational axis, an angular first actuating cam surface 188 is provided on the body portion 178, and it includes a planar actuator-engagement surface 188*a*. A planar abutment surface 190 on the body portion 178 intersects the engagement surface 188*a* along a common edge 191 and at an obtuse angle thereto. An actuator clearance recess or groove 192 is disposed centrally between the planar side surfaces 176, adjacent to the actuating cam surface 188. Remaining on opposite sides of the recess 192 are arcuate segments 194, which provide portions of the socket wall-engagement surface 182, and also provide generally radially extending straight retracting cam surfaces 196, disposed inwardly of the rotational axis of the lug. Recesses are provided in the body portion 178, adjacent to the planar side surfaces 176, to provide two spaced apart generally angular second actuating cam surfaces 198 on the laterally inner side of each lug, inwardly of its rotational axis.

Referring particularly to FIGS. 8–13, the actuator 100 includes an elongated actuating rod 200, an actuating head 202 on an inner end of the rod, and a roll pin handle 204 on an opposite, outer end of the rod. A longitudinal slot 206 is provided in the actuating rod 200, adjacent to its upper end. A transverse pin opening 208 in the rod 200 intersects the slot 206 adjacent to its inner end. A release cable 210 having a thin protective plastic sheath or coating 212 therearound is pivotally secured to the actuating rod 200 at one end of the cable by a cable clamp 214. The claim 214 is pivotally mounted in the slot 206 by means of a roll pin 216 extending through the pin opening 208 and through a rounded end 214*a* on the clamp 214. An access opening 218 (FIG. 8) is provided in the mounting portion 128 of the housing 94, in register with the pin opening 208 in the actuating rod 200 when the latter is disposed as illustrated in FIG. 8, to permit access to the roll pin 216 for insertion and removal thereof. The cable 210 having the sheath 212 thereon extends longitudinally outwardly or vertically upwardly in the rod slot 206, emerges therefrom over the housing mouth 152, extends laterally outwardly therefrom, and terminates in an outer end to which a connector 220 is affixed, as illustrated in FIG. 2. An opening 220*a* is provided in the connector, for attachment of a lanyard or the like to the cable.

Figure 11:
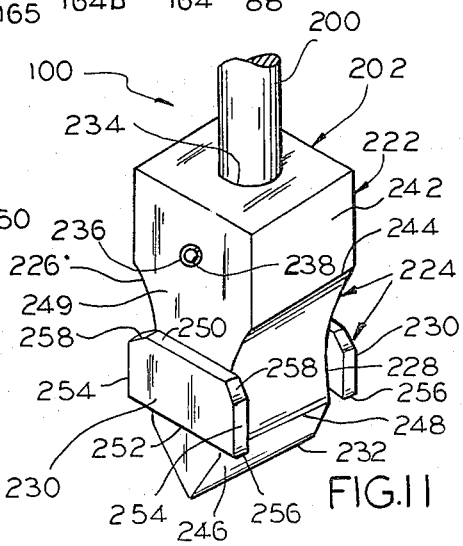
FIG. 11 is an enlarged perspective view of the actuator head.
Figure 14:
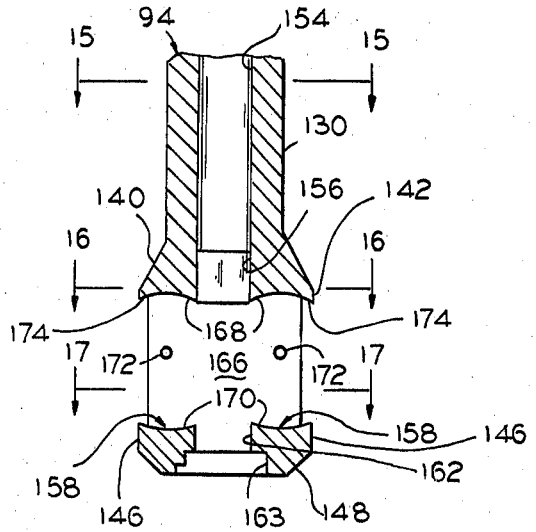
FIG. 14 is a fragmentary vertical sectional view of the inner or lower end of the housing, oriented as in FIG. 13.
Figure 15:
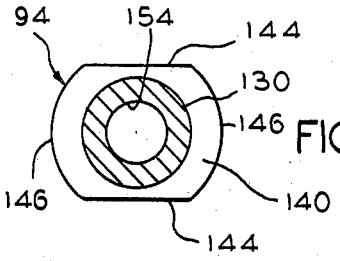
FIGS. 15, 16 and 17 are horizontal sectional views of the housing, taken substantially on lines 15—15, 16—16, and 17—17, respectively, of FIG. 14.
Figure 16:
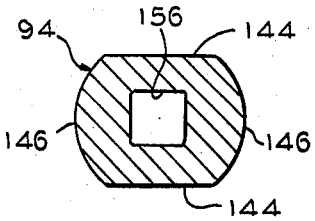
Figure 17:
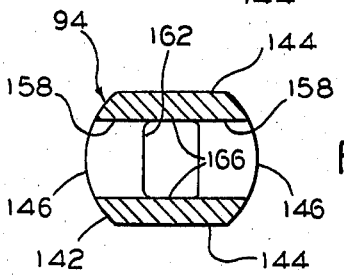
Figure 18:
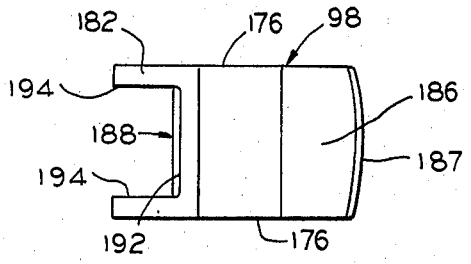
FIGS. 18, 19, 20, 21 and 22 are enlarged top plan, inner end elevational, side elevational, outer end elevational, and vertical sectional views, respectively, of a lifting lug.
Figure 19:
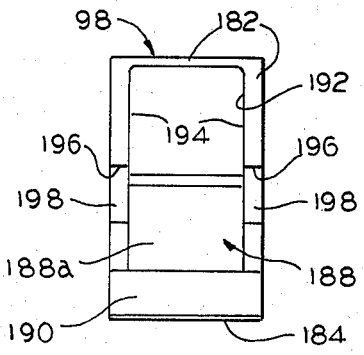
Figure 20:
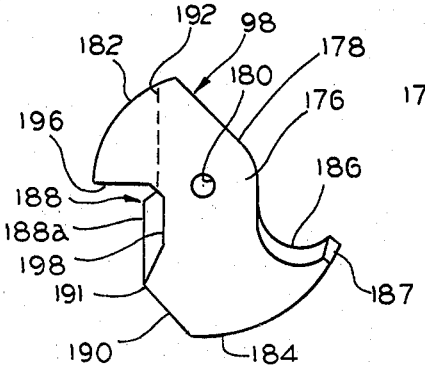
Figure 21:
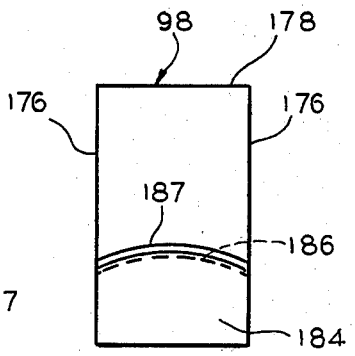
Figure 22:
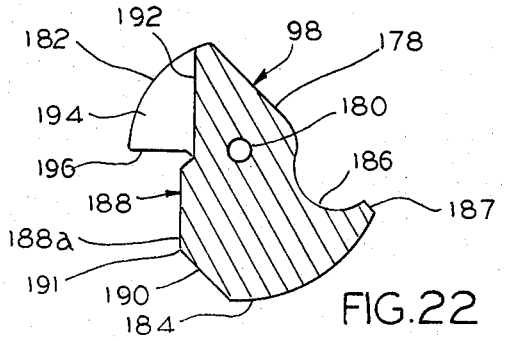

Referring to FIG. 11, the actuating head 202 is an integral one-piece structure of a substantially rectangular block-like lug-locking portion 222 and a cam portion 224. The cam portion 224 includes a converging portion 226 integral with the lug-locking portion 222, a wedge portion 228 integral with the converging portion and forming the bottom of the head 202, and a pair of flange portions 230 integral with the wedge portion on opposite sides thereof. The flange portions 230 are disposed adjacent to the converging portion 226 and spaced upwardly from a leading edge 232 on the wedge portion. The locking portion 222 is provided with a central vertical cylindrical blind bore 234 receiving the lower end of the actuating rod 200 therein. The head 202 and the rod 200 are secured together rigidly by a roll pin 236, which extends through registering pin holes 238 and 240 (FIG. 23) in the locking portion 222 and the rod, respectively.

Parallel vertical planar lug-engagement surfaces 242 are provided on opposite sides of the locking portion 222. Lower horizontal edges 244 of such surfaces, which edges also are the upper edges of the converging portions 226, may serve as contact surfaces for camming purposes, as described hereinafter. The lower end of the wedge portion 228 is V-shaped, having planar contact surfaces 246 at angles of 45° to the vertical, and an angle of 90° to each other. The contact surfaces 246 share the leading edge 232 as the horizontal lower edge of each surface, and the contact surfaces have horizontal upper edges 248.

The flange portions 230 have a flat plate-like configuration, and they extend outwardly from parallel vertical planar side surfaces 249 on the head 202, which surfaces lie in planes perpendicular to the planes of the lug-engagement surfaces 242. The distance between the side surfaces 249 is the same as the width of the actuator-engagement surface 188*a* of a lug 98. The flange portions 230 have parallel narrow horizontal planar upper and lower edge surfaces 250 and 252, respectively, which extend laterally outwardly from the wedge portion 228, and parallel narrow vertical planar side edge surfaces 254, which are substantially coplanar with the lug-engagement surfaces 242. Square lower corners 256 are formed on the flange portions 230 by the junctures of the side edge surfaces 254 and the lower edge surface 252. Upper corner bevels 258 are formed on the flange portions 230, at angles at 45° to the vertical.

Figure 10:
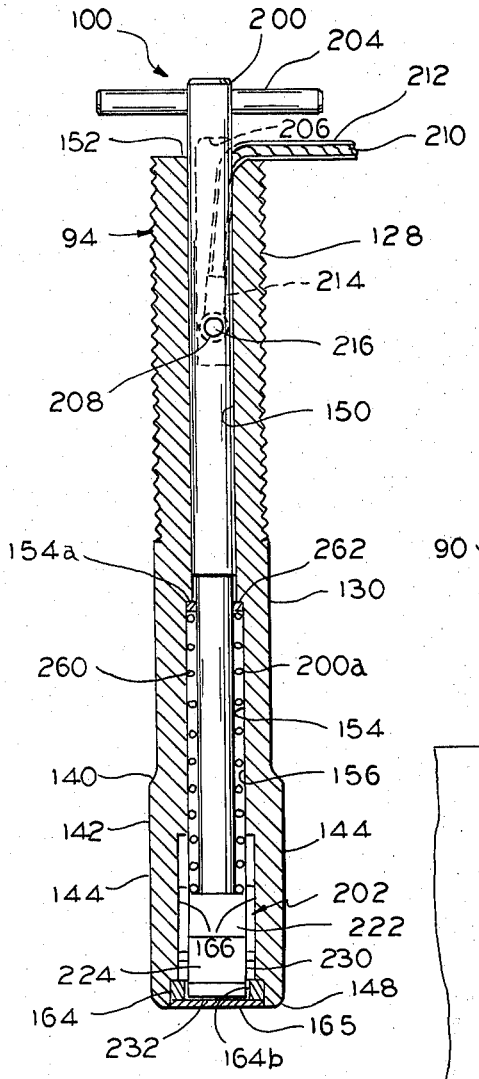
FIG. 10 is a vertical sectional view of a housing and an actuator therein, removed from the pickup unit and oriented as in FIG. 2.

Referring to FIGS. 8 and 10, the actuator rod 200 is mounted for longitudinal or axial reciprocal movement in the bores 150, 154, and 156 of the housing 94. A resilient biasing member in the form of a coil compression spring 260 is mounted around an inner reduced diameter portion 200*a* of the actuating rod 200 and is seated and bears on top of the actuating head 202. The upper or outer end of the spring 260 bears on a washer 262, which is slidable on the reduced diameter portion 200*a* and seats on an annular shoulder 154*a* at the juncture of the outer and intermediate bores 150 and 154. The spring 260 thus biases the actuator 100 inwardly or downwardly with respect to the housing 94.

Figure 9:
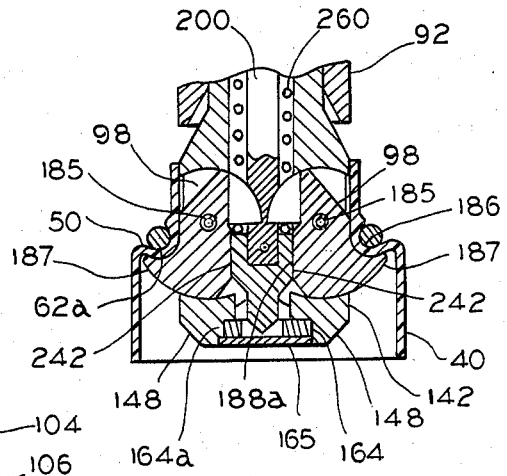
FIG. 9 is a fragmentary view of the lower end of the pickup unit as illustrated in FIG. 8, with additional parts shown in vertical sectional view.
Figure 12:
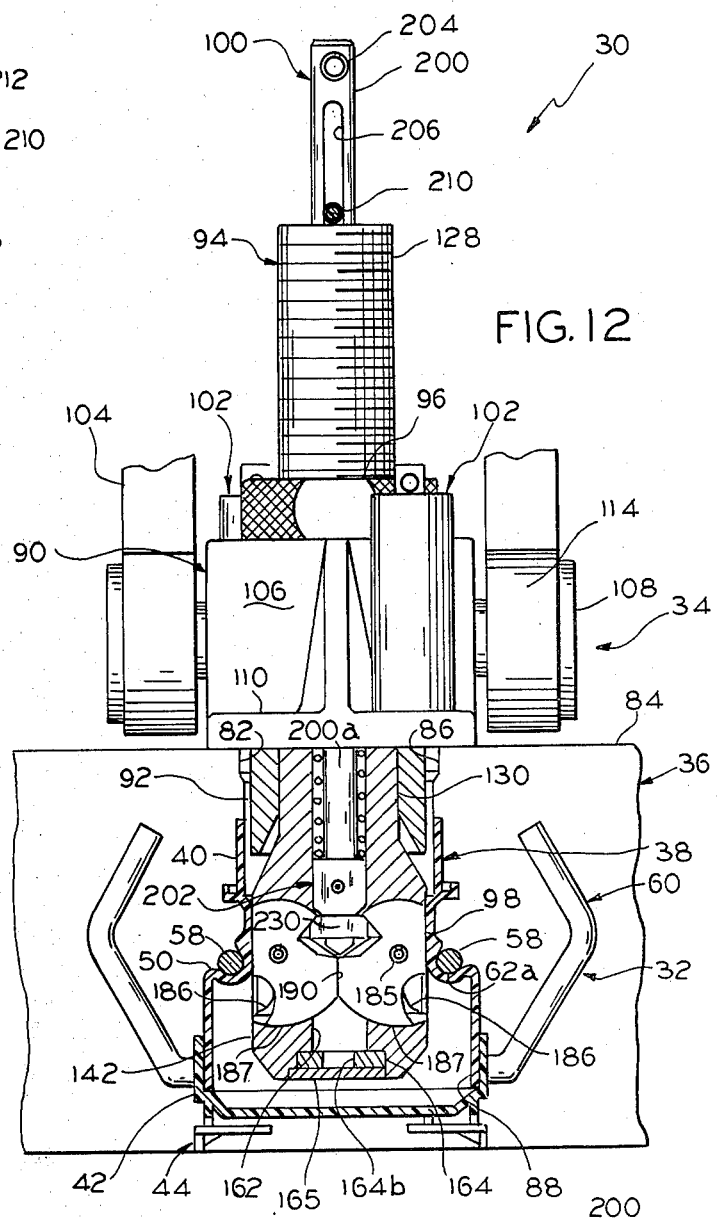
FIG. 12 is an elevational and partly sectional view, with parts broken away, corresponding to the view of FIG. 8 but with the actuator and lifting lugs of the pickup unit retracted.
Figure 13:
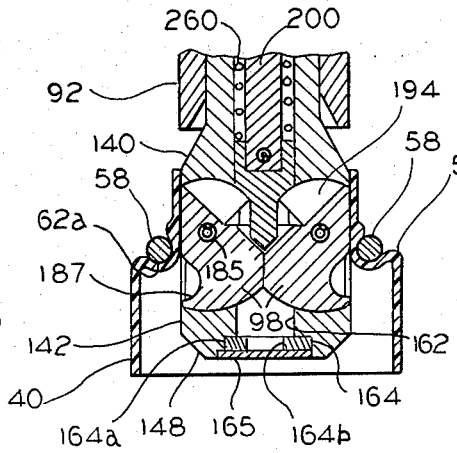
FIG. 13 is a view similar to FIG. 9, but showing the actuator and the lifting lugs as they appear in FIG. 12.
Figure 23:
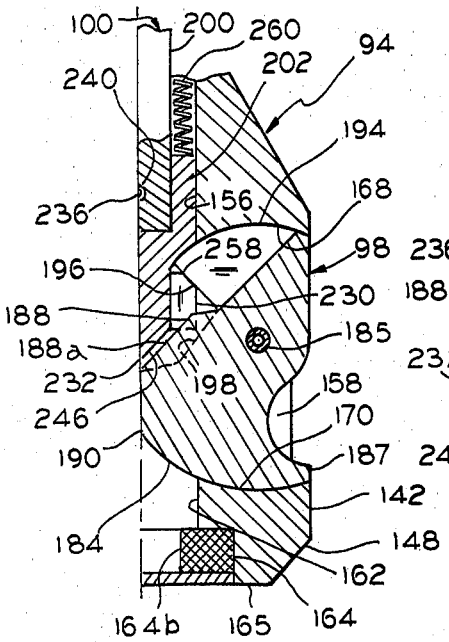
FIGS. 23–27 are enlarged fragmentary vertical sectional views similar to FIGS. 9 and 13, illustrating sequentially the actuation of a lifting lug.
Figure 24:
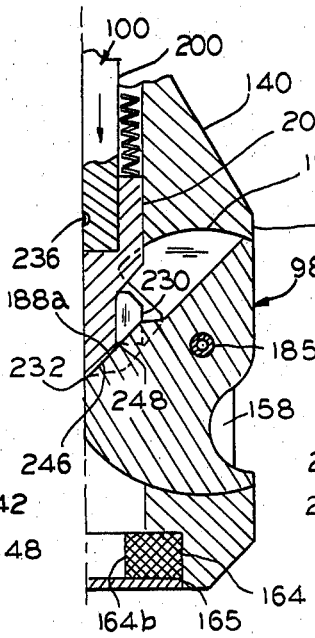
Figure 27:
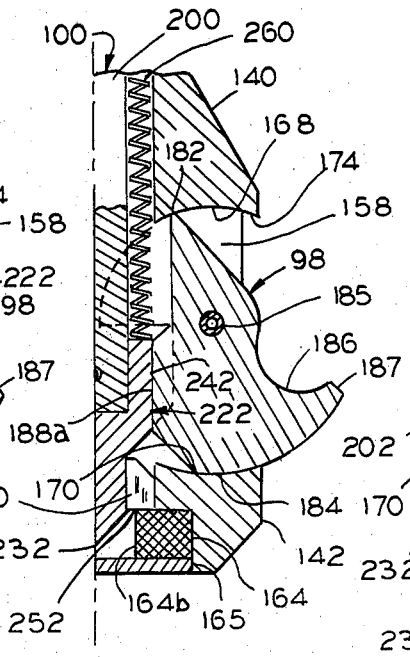
Figure 28:
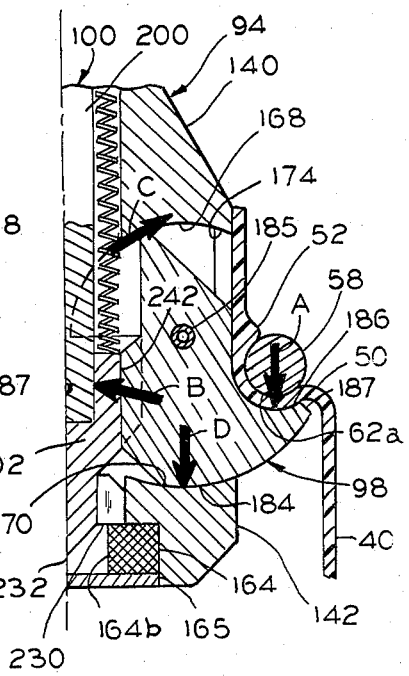
FIG. 28 is a view like FIG. 27 additionally illustrating the lifting lug under load and indicating by arrows the directions of the forces exerted.

The actuator 100 reciprocates between arbitrarily designated first and second positions to engage the lifting lugs 98 and rotate them simultaneously to an extent corresponding to the movement of the actuator, between respective first and second dispositions of the lugs. FIGS. 10 and 27 illustrate the first position of the actuator 100 and the corresponding first disposition of the lugs 98, which the parts assume both when the pickup unit 34 is not in use and when the unit is inserted in an insert 32 for load-lifting purposes, the latter as illustrated in FIGS. 8, 9 and 28. FIG. 23 illustrates the second position of the actuator 100 and the second disposition of the lugs 98, which the parts assume when retracted either for insertion of the pickup unit 34 into an insert 32 or for removal of the unit therefrom, the latter as illustrated in FIGS. 12 and 13.

In the first position of the actuator 100, the locking portion 222 of the actuating head 202 is interposed between the lugs 98, with the lug-engagement surfaces 242 of the former in abutting frictional engagement with the actuator-engagement surfaces 188*a* of the latter. In the second position, the locking portion 222 is retracted or raised into a position within the square bore 156 of the housing, and the cam portion 224 of the head is interposed between the lugs 98, with the bevels 258 on the flange portions 230 engaging the retracting cam surfaces 196 on the lug segments 194.

The actuator 100 is retracted from its first position illustrated in FIG. 27 to its second position illustrated in FIG. 23, thereby to retract the lugs 98 for insertion of the unit 34 into an insert 32, by pulling outwardly either on the handle 204 or on the cable 210, against the tension of the spring 260. At this time, the lugs 98 are in abutting engagement at their abutment surfaces 190 and disposed completely within the sockets 158. Consequently, the housing 94 containing the actuator 100 and the lugs 98 may be inserted into the cage 38 and the cavity 88 therein to the extent shown in FIG. 12.

Figure 26:
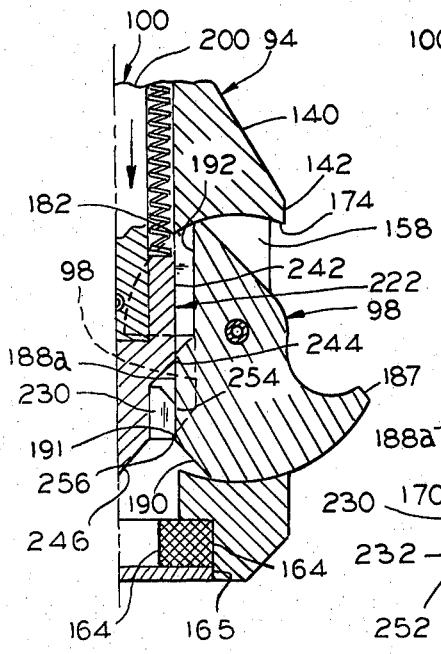

In moving from the first position to the second position, the actuator moves through the intermediate position illustrated in FIG. 26, with the lugs 98 remaining in their first or starting dispositions, owing to a lost motion-type of connection between the parts. Thereafter, the flange portions 230 of the actuator head 202 engage the retracting cam surfaces 196 on the lugs 98 in successive intermediate positions of the parts, not illustrated, to rotate the lugs into their second or retracted dispositions.

When the handle 204 or the cable 210 is released, the actuator 100 and the lifting lugs 98 go through the sequence of movements illustrated in FIGS. 24–27, thereby placing the lugs in lifting engagement with the primary anchor rods 58, as illustrated in FIGS. 8, 9 and 28. In the first action of the actuator 100, illustrated in FIG. 24, it moves downwardly or inwardly, and the contact surfaces 246 of the head 202 make contact with the actuator-engagement surfaces 188*a* of the first actuating cam surfaces 188 on the lugs. The locking portion 222 of the head 202 moves in the clearance recess 192 between the lug segments 194 in each pair. The leading edge 232 of the head is disposed at the juncture of the abutment surfaces 190 of the lugs. Continued downward movement of the actuator 100 causes the upper edges 248 of the contact surfaces 246 to move downwardly on the actuator-engagement surfaces 188*a*, and thereby rotate both lugs 98, in opposite directions. In this connection, it will be noted that the contact between the surface 246 and the edge 248 thereof, and the engagement surface 188*a* on each lug is at a level equal to or below the axis of rotation of the lug, which substantially is the axis of the roll pin 185. In this manner, the moment arm tending to rotate the lug increases in length, whereas if it were to shorten, binding might occur.

Figure 25:
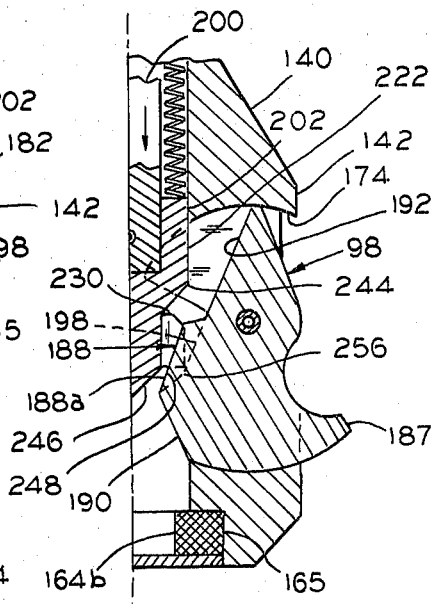

As illustrated in FIG. 25, further downward movement of the actuator 100 results in separation of the edges 248 of the contact surfaces 246 from the engagement surfaces 188*a* on the lugs. The opposite corners 256 of the flanges 230 next contact the second actuating cam surfaces 198 on the lugs 98, with each contact being made at a level below the axis of rotation of the lug. Such engagement and further downward movement of the actuator 100 serves to complete the rotation of the lugs into their laterally protruding first dispositions, wherein the projecting portion 187 of each lug protrudes through the mouth 174 of its socket 158 into engagement with the adjacent lug-engagement surface 62*a* on an anchor rod 58, to connect the pickup unit 34 to the insert 32. Movement into such disposition is illustrated in FIG. 26, where a corner 256 of the flange portion 230 is shown as leaving the cam surface 198 on a lug, and an engagement surface 242 on the locking portion 222 of the head is shown as entering into engagement with the engagement surface 188*a* on the lug. Should the corners 256 on the flange portions 230 wear excessively, the function of completing the rotation of the lugs 98 will be taken over by the locking portions 222 of the head 202. Thus, in that case, the lower edges 244 of the lug-engagement surfaces 242 will make contact with the first actuating cam surfaces 188 of the lugs upon downward movement of the actuator from the position illustrated in FIG. 25, and rotate the lugs by cam action to the position illustrated in FIG. 26.

Provision is made for overtravel of the actuator 100 upon further downward movement thereof, into the so-designated first position of FIG. 27. Substantially the entire lug-engagement surface 242 on each side of the head 202 then engages the adjacent actuator-engagement surface 188*a* on the lug, while the flange portions 230 are received in the bottom bore 162 and the leading edge 232 is received in the hole 164*b* in the stop washer 164. The travel of the actuator 100 is limited and its position determined by abutment of the lower edge surfaces 252 of the flange portions 230, on the upper surface of the stop washer 164. The locking portion 222 of the actuating head 202 forms a positive mechanical lock, and the overtravel assures that the lugs 96 will not rotate out of their engagement with the anchor insert 32 under load, even if some movement of the actuator 100 and its head 202 relative to the lugs were to occur, or if the actuator head surfaces 242 were not moved into complete engagement with the lug surfaces 188*a*, as in FIG. 27.

When the actuator 100 is subjected to an outward pulling force, by pulling either on the handle 204 or on the cable 210, and the ejectors 102 are armed, the force of the ejectors 102 acts to retract the lugs 98, as will appear from the description which follows. The resulting sequence of movements, in general, is substantially the reverse of the sequence of FIGS. 23–27. At the beginning of the sequence and as illustrated in FIG. 26, the flange portions 230 engage the lugs at the upper edges 191 of the abutment surfaces 190, to prevent the lugs from rotating until the locking portion 222 is completely disengaged from the engagement surfaces 188*a* on the lugs. Thereafter, the lugs 98 follow successively the camming surfaces 256, 248 and 246 on the head 202, until they reach the disposition of FIG. 24, wherein the lugs are disposed completely within the sockets 158. Further outward movement of the actuator 100 places it in the so-designated second position of FIG. 23, wherein the lugs are forcibly urged into the sockets 158 and also are prevented from rotating in one direction by engagement of the bevels 258 and the retracting cam surfaces 196. The lugs are prevented from rotating in the opposite direction by engagement of the abutment surfaces 190 on the respective lugs with each other (see FIGS. 12 and 13).

Figure 6:
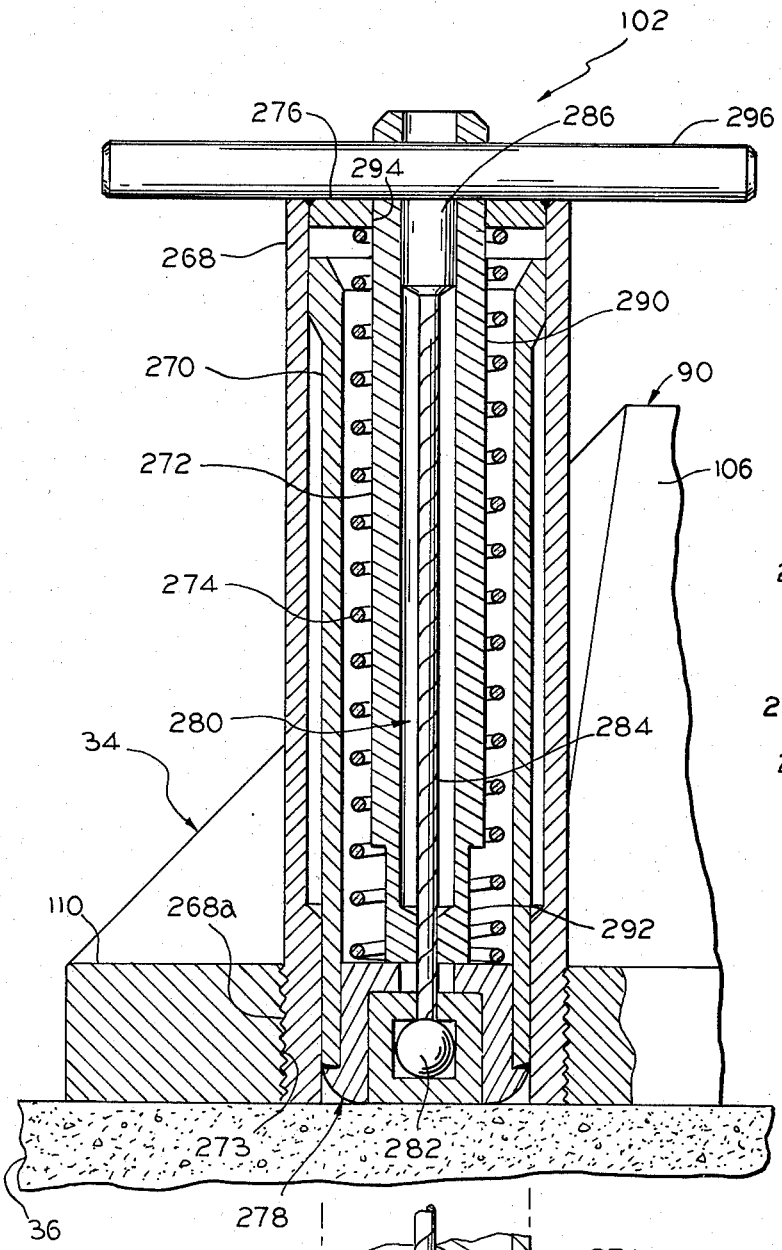
FIG. 6 is a vertical sectional view of the ejector, on a smaller scale, taken substantially on line 6—6 of FIG. 7 and illustrating the ejector as it appears when cocked.
Figure 6:
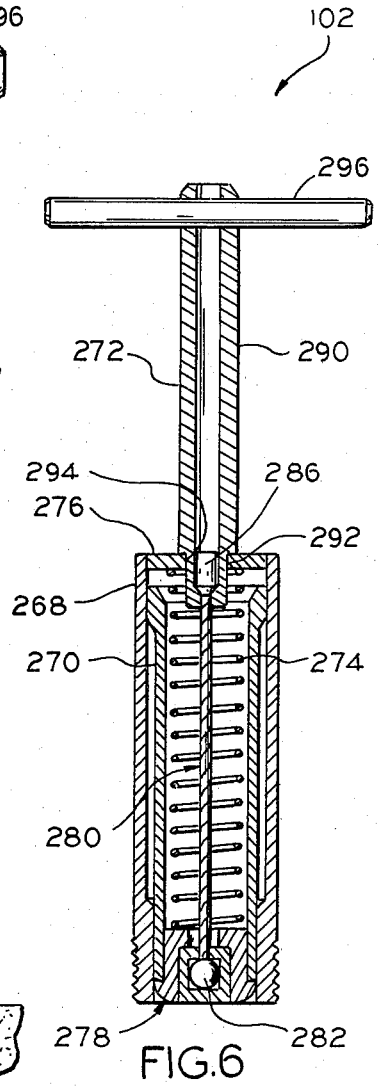
Figure 5:
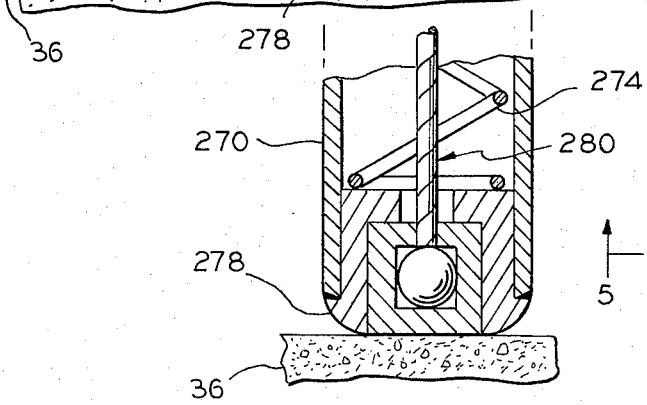
FIG. 5 is an enlarged vertical sectional illustration of an ejector component of the pickup unit, showing a plunger thereof in two views corresponding to alternative dispositions of the parts, and taken substantially on line 5—5 of FIG. 7.
Figure 7:
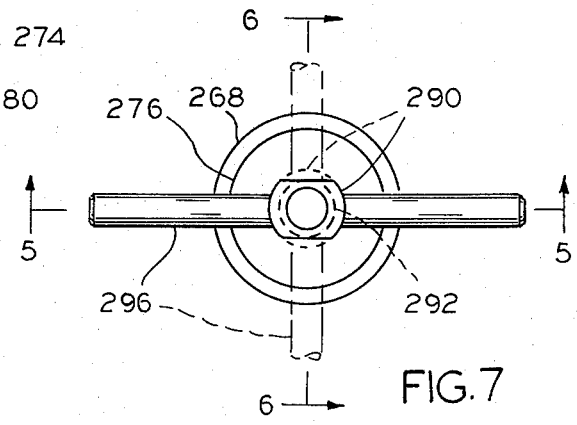
FIG. 7 is a top plan view of the ejector as it appears in FIG. 5, on a smaller scale, with its appearance when cocked illustrated in phantom lines.

Referring to FIGS. 5–7, each ejector 102 is constructed of three generally cylindrical and coaxial tubular members in telescopic relationship, including an outer mounting casing or reaction member 268, an intermediate plunger 270, and an inner locking member 272. The casing 268 has a threaded lower end portion **268*a* which engages a threaded opening 273 in the bearing plate 110 of the support member 90**, to secure the casing in an upright position on the plate.

The casing 268 and the plunger 270 are axially or longitudinally reciprocally movable relative to each other, between a position wherein the plunger is completely enclosed within the casing and a downwardly projecting relative position, as illustrated by the two views in FIG. 5. The casing 268 and the plunger 270 are biased or urged apart by a coil compression spring 274 interposed therebetween. The spring 274 is mounted within the plunger 270 and around the locking member 272, and it bears on a closure ring 276 forming part of the upper end of the casing 268, and a plug assembly 278 forming part of the lower end of the plunger 270.

The plunger 270 and the locking member 272 are interconnected by a coupler 280, in a lost motion-type of connection. The coupler 280 includes a ball 282 which is held by the plug assembly 278, a short length of cable 284 which is fastened to the ball at one end of the cable, and a retention head 286 which is fastened to the opposite end of the cable and is axially slidable in the locking member 272.

The locking member 272 is constructed integrally of an upper oblong section 290, which extends for the greater part of its length, and a lower cylindrical section 292. The locking member 272 extends through and is slidable in an oblong opening 294 in the ring 276, which opening conforms closely to the periphery of the oblong section 290. A roll pin handle 296 extends transversely through the upper end of the oblong section 290.

The ejector 102 may be cocked by gripping the handle 296 and pulling it outwardly from the casing 268, rotating the handle and thereby the locking member through an angle of approximately 90°, and releasing the handle. The oblong section 290 of the locking member then abuts on and is restrained by the ring 276, as illustrated in FIG. 6 and in phantom lines in FIG. 7. The coupler 280 functions to releasably lock the ejector 102, securing the plunger 272 to and within the casing 268, against the bias of the spring 274.

The ejector 102 may be armed, with the parts disposed as shown in the upper view of FIG. 5, by rotating the handle 296 and thereby the locking member 272 from their positions in FIG. 6 through an angle of 90°, and releasing the handle. With the support member 90 connected to the slab 36 so as to place the ejector 102 under restraint, the ejector is maintained in the condition illustrated in the upper view of FIG. 5, wherein the casing 268 is telescoped over the plunger 270. When the restraint is removed, the spring 274 acts to move the casing 268 together with the locking member 272 outwardly, while the plunger 270 bears against the slab 36, as illustrated by the lower view of FIG. 5. Inasmuch as the casing 268 is fixed to the support member 90 of the pick-up unit 34, the entire pick-up unit is ejected from the slab 36.

When the pick-up unit 34 is to be connected to an anchor insert 32 embedded in a slab 36, the ejectors 102 are cocked, as described above. An operator then pulls outwardly on the handle 204 of the actuator 100 to retract the lugs 98, as illustrated in FIG. 23, and inserts the body portion 142 of the housing 94 through the opening 82 and the passageway 86 in the slab 36 and into the cavity 88 in the cage 38. The bearing sleeve 92 also enters the passageway 86 and the cage 38. The handle 204 is released, whereupon the spring 260 in the housing biases the actuator 100 downwardly. The downward movement of the actuator 100 rotates the lugs 98 into their laterally protruding dispositions, illustrated in FIGS. 27 and 28.

It may be necessary at this time to adjust the elevation at which the housing 94 is supported on the support member 90 of the pickup unit by turning the lock nut 96 on the threaded mounting portion 128 of the housing. The adjustment brings the lugs 98 into contact with the cage shoulders 50, in engagement therewith and with the lug-engagement surfaces **62*a* of the primary anchor rods 58. The lock nut 96 next may be backed off slightly, to provide freedom for rotation of the support member 90 relative to the housing 94 and the lock nut 96. The foregoing adjustment is made to accommodate the varying thicknesses or depths of the slab 36, both for slabs of different sizes and for variations in the pour of slabs having the same nominal thickness. Where the slab thickness does not vary appreciably, it may not be necessary to adjust the lock nut 96 with each use of the pickup unit 34**.

With the pickup unit 34 properly connected to the insert 32 and oriented with respect to the hoisting or lifting mechanism, the ejectors 102 are armed, by rotating their handles 296 to the full-line position illustrated in FIG. 7 and lowering the handles. The parts of the ejectors then are in the positions illustrated in the upper portion of FIG. 5, and the lifting apparatus 30 is in the condition illustrated in FIGS. 1, 2, 8 and 9. The interconnection of the pickup unit 34 and the anchor insert 32 serves to hold the support member 90 in place against the pressure of the ejector springs 274, with the bearing plate 110 seated on the external surface 84 of the slab 36. Ejector spring pressure causes the lug projecting portions 187 to bear on the cage shoulders 50 beneath the anchor rods 58. A hoisting hook or the like on the end of a lifting cable, not shown, is connected to the lifting bail 104, and additional hooks are connected to the bails of other pickup units secured to other inserts embedded in the slab 36, preparatory to lifting the slab.

As the lifting cables act to exert lifting forces on the bails 104 and thereby on the housings 94 of the pickup units 34, the load forces imposed by the slab 36 are exerted on individual units, generally as indicated by the arrows A, B, C and D in FIG. 28. Thus, the load borne by one of the primary anchor rods 58 of an insert 32 is transmitted to the engagement surface 186 on the projecting portion 187 of a lug 98 in the direction of the arrow A. A torque or moment of force is produced. The torque force is transmitted by the lug to the actuating head 202 and to the housing 94, generally as represented, respectively, by the arrows B and C. The engagement surfaces 242 on opposite sides of the head 202 function as reaction surfaces providing resistance to the torque forces transmitted to the head 202 by the two lugs 98 of each pickup unit. The top wall surfaces 168 of the sockets 158 function as reaction surfaces providing resistance to the torque forces transmitted to the housing 94 by the lugs 98. The resistance in each case acts to prevent the lugs 98 from being rotated out of their protruding first dispositions.

With the lugs 98 secured against rotation, the weight load forces transmitted by the anchor rods 58 to the lugs in turn are transmitted by the lugs to the housing 94 at the bottom wall surfaces 170 of the sockets 158, generally as represented by the arrow D in FIG. 28 for one anchor rod and the lug in engagement therewith. The bottom wall surfaces 170 function as reaction surfaces engaging the lugs 98 for load transfer. Neither torque force nor weight load force is transmitted by the lugs 98 to their mounting pins 185. The weight load forces are transmitted by the housing 94 to the support member 90 via the lock nut 96, and by the support member to the bail 104 and thence to the lifting apparatus.

It is to be understood that the arrows A, B, C and D have been included in the drawings to assist in understanding the functioning of the apparatus, and that their locations and directions are approximate and somewhat idealistic. In practice, the lugs 98 require certain clearances in the sockets 158, resulting in slight tipping and deformation under load with corresponding force distribution.

As the lifting operation proceeds, the slab 36 is moved from the illustrative horizontal position to a tilted position, during which the bearing sleeve 92 acts to distribute the forces around the mouth of the opening 82 in the slab. The bail and the support member 90 may turn somewhat about the housing 94. Ultimately, the slab 36 is erected in a vertically extending position and braced, at which time the pickup units 34 may be disconnected from the inserts 32 and removed from the slab.

In order to disconnect a pickup unit 34 from an insert 32, it is necessary to pull outwardly on the actuating rod 200, either by means of the handle 204 or by means of the release cable 210, thereby to withdraw the actuator 100 from the housing 94 and retract the lugs 98 from their engagement with the primary anchor rods 58. Inasmuch as the pickup unit 34 may be at a considerable height above ground level when the slab is erected, a preferred procedure is to connect a lanyard to the connector 220, inserting it through the opening 220*a*. An operator on the ground, remote from the pickup unit, pulls downwardly and outwardly on the lanyard, to pull the release cable 210 in the same direction.

The lugs 98 move into their retracted positions principally as a result of the transmission thereto of the tension of the ejector springs 274, which urge the housing 94 and thereby the lugs outwardly relative to the insert 32. The relative movement causes the lugs to rotate into their sockets 158, by cam action of the projecting portions 187 of the lugs moving on the insert shoulders 50. The actuator 100 supplies any necessary retraction force not supplied by the ejector springs, with the flange portions 230 of the head 202 acting on the retracting cam surfaces 196 to rotate the lugs. In general, the sequence of movements of the parts is substantially the reverse of the sequence of FIGS. 23–27, as described above.

When the lugs 98 have been retracted completely within the sockets 158, as illustrated in FIG. 12, the pickup unit 34 is ejected from the slab 36, by the action of the ejectors 102. Preferably, the structure of the ejectors is such as to cause the housing 94 to be removed completely from the opening 82 in the slab. The pickup unit then remains dangling from the lifting cable, and it may be removed after lowering the cable to the ground. The passageway 86 and the cavity 88 formed by the cage 38 of the insert 32 may be filled with grout, to finish the face of the slab.

The locking mechanism of the ejector 102 may be omitted, if desired, with suitable design of the remaining components of the ejector. In such case, it is necessary to insert the pickup unit 34 into an embedded anchor insert 32 against the forces of the ejector springs 274 or the like, pushing down on the support member 90 for that purpose.

As an additional but less advantageous alternative, the ejectors 102 may be omitted entirely from the pickup unit 34. In such case, the lugs 98 are retracted for removal of the unit from an insert 32 solely by engagement of the flange portions 230 of the actuator head 202, with the retracting cam surfaces 196 on the lugs, as the actuator 100 is moved outwardly by pulling on the actuating rod 200. The retraction takes place in the same manner as when preparing the pickup unit for insertion into an insert 32, as described above. No contribution to the retraction is made by ejector springs. The pickup unit is removed from the slab 36 by additional or continued pulling on the actuating rod 200, which engages the remainder of the unit for movement therewith.

The illustrative mounting of the lugs 98 for load transfer purposes is preferred, inter alia, as not requiring the mounting pins 185 to carry a shear load and not necessitating careful and precise location of the pins and corresponding pin openings for load-carrying purposes. However, it will be understood that a minor proportion of the torque load might be carried by the mounting pins 185, although less advantageously. Preferably, any torque load transmitted to the mounting pins is at the expense of the load transmitted to the top wall surfaces 168 of the sockets 158. The function of the mounting pins 185 in the illustrative embodiment is to keep the lugs 98 from falling out of the sockets 158 when not in an insert 32.

It will be apparent to those skilled in the art that various other changes and modifications may be made in the preferred illustrative embodiment within the spirit and scope of the invention. It is intended that all such changes and modifications be included within the scope of the appended claims.

I claim:

1. In apparatus for releasable connection to a member embedded in an object adjacent to a cavity which provides access to the member and communicates with an opening in an external surface of the object, said member having a plurality of lug-engagement surfaces disposed in angularly spaced relation about said cavity and each facing in a direction away from said external surface, the improvement comprising:

a housing having an inner end portion and an outer end portion and extending longitudinally therebetween, said housing being adapted for insertion of its inner end portion through said opening and into said cavity, means defining a longitudinal bore in said housing, means defining a plurality of lug-mounting sockets in said inner end portion, each of said sockets communicating with said bore laterally inwardly of the socket and having a laterally outer mouth disposed to face an adjacent one of said lug-engagement surfaces when said inner end portion is in said cavity, a lug mounted in each of said sockets for reciprocal rotational movement therein between a first disposition wherein a portion of the lug protrudes laterally through the mouth of the socket into engagement with the adjacent lug-engagement surface to connect the apparatus to said member, and a second disposition wherein said lug portion is withdrawn from said engagement to release the apparatus from the member, actuating means longitudinally movably mounted in said bore for reciprocation between first and second positions to engage said lugs and rotate them correspondingly between their first and second dispositions, said actuating means having first reaction surfaces disposed when in said first position between said lugs in engagement therewith and thereby providing resistance acting to prevent the lugs from being rotated out of their first dispositions by load forces exerted on the lug by said member, and seating means for each lug included in said socket-defining means and providing a second reaction surface facing in a direction toward said external surface of the object and engaging the lug for transferring to said housing load forces exerted on the lug by said member.

2. Apparatus as defined in claim 1 and wherein said socket-defining means additionally includes a third reaction surface facing oppositely to said second reaction surface in each socket and engaging the lug mounted in the socket, said third reaction surfaces providing additional resistance acting to prevent the lugs from being rotated out of their first dispositions by load forces exerted on the lugs by said member.

3. Apparatus as defined in claim 2 and adapted for connection to a member which includes a pair of oppositely disposed anchor rods providing said lug-engagement surfaces, said apparatus including a pair of said lug-containing sockets oppositely disposed.

4. Apparatus as defined in claim 2 and wherein each of said lugs includes means providing cam surfaces extending laterally inwardly of the rotational axis of the lug, and said actuating means includes a head member provided with said first reaction surfaces and also with a contact surface for each of said cam surfaces, said contact surfaces acting upon the cam surfaces of each lug to rotate the lug alternately from the first to the second disposition thereof and vice versa upon corresponding movement of the actuating means, said first reaction surfaces moving into said engagement with the lugs with overtravel following said contact surface action to rotate the lugs into their first disposition.

5. Apparatus as defined in claim 1 and wherein each of said lugs includes means providing cam surfaces extending laterally inwardly of the rotational axis of the lug, and said actuating means includes a head member provided with said first reaction surfaces and also with a contact surface for each of said cam surfaces, said contact surfaces acting upon the cam surfaces of each lug to rotate the lug alternately from the first to the second disposition thereof and vice versa upon corresponding movement of the actuating means, said first reaction surfaces moving into said engagement with the lugs with overtravel following said contact surface action to rotate the lugs into their first disposition.

6. Apparatus as defined in claim 5 and adapted for connection to a member which includes a pair of oppositely disposed anchor rods having round cross sections providing said lug-engagement surfaces in arcuate configuration, said apparatus including a pair of said lug-containing sockets oppositely disposed, and said lug portions each including a rod-engagement surface having an arcuate configuration complementary to said configuration of the adjacent lug-engagement surface.

7. In a pickup unit for releasable connection to an anchor insert embedded in a concrete body adjacent to a cavity which provides access to the insert and communicates with an opening in an external surface of the body, said insert including a pair of oppositely disposed anchor rods each having a lug-engagement surface facing in a direction away from said external surfaces, the improvement comprising:

a housing having an inner end portion and an outer end portion and extending longitudinally therebetween, said housing being adapted for insertion of its inner end portion through said opening and into said cavity, means defining a longitudinal bore in said housing, means defining a pair of lug-mounting sockets oppositely disposed in said inner end portion, each of said sockets communicating with said bore laterally inwardly of the socket and having a laterally outer mouth disposed to face an adjacent one of said lug-engagement surfaces when said inner end portion is in said cavity, a lug mounted in each of said sockets for reciprocal rotational movement therein between a first disposition wherein a portion of the lug protrudes laterally through the mouth of the socket into engagement with the adjacent lug-engagement surface to connect the unit to said insert, and a second disposition wherein said lug portion is withdrawn from engagement to release the unit from the insert, actuating means longitudinally movably mounted in said bore for reciprocation between first and second positions to engage said lugs and rotate them correspondingly between their first and second dispositions, said actuating means having first reaction surfaces disposed when in said first position between said lugs in engagement therewith and thereby providing resistance acting to prevent the lugs from being rotated out of their first dispositions by load forces exerted on the lug by said insert, and seating means for each lug included in said socket-defining means and providing a second reaction surface facing in a direction toward said external surface of the body and engaging the lug for transferring to said housing load forces exerted on the lug by said insert.

8. A pickup unit as defined in claim 7 and wherein said first reaction surfaces engage said lugs at the laterally inner ends of said sockets, each of said second reaction surfaces is disposed on one side of its socket, and said socket-defining means additionally includes a third reaction surface disposed on the opposite side of each socket and engaging the lug mounted in the socket, said third reaction surfaces providing additional resistance acting to prevent the lugs from being rotated out of their first dispositions by load forces exerted on the lugs by said insert.

9. A pickup unit as defined in claim 8 and wherein said anchor rods each have a round cross section providing its lug-engagement surface in arcuate configuration, and said lug portions each include a rod-engagement surface having an arcuate configuration complementary to said configuration of the adjacent lug-engagement surface.

10. A pickup unit as defined in claim 8 and wherein each of said lugs includes means providing cam surfaces extending laterally inwardly of the rotational axis of the lug, and said actuating means includes a head member provided with said first reaction surfaces and also with a contact surface for each of said cam surfaces, said contact surfaces acting upon the cam surfaces of each lug to rotate the lug alternately from the first to the second disposition thereof and vice versa upon corresponding movement of the actuating means, said first reaction surfaces moving into said engagement with the lugs with overtravel following said contact surface action to rotate the lugs into their first disposition.

11. A pickup unit as defined in claim 10 and wherein said lugs abut on each other in said second disposition thereof to limit their rotation, whereby the lugs are disposed completely within their sockets.

12. In a combination of an anchor insert adapted to be embedded in a concrete body adjacent to a cavity which provides access to the insert and communicates with an opening in an external surface of the body, said insert having a plurality of lug-engagement surfaces disposed in angularly spaced relation about said cavity and each facing in a direction away from said external surface, and a pickup unit releasably connectable to said insert and which includes a support member adapted to be mounted on said external surface adjacent to said opening, and lifting means connected to said support member, the improvement comprising:

a housing included in said pickup unit and having an inner end portion and an outer end portion and extending longitudinally therebetween, said housing being adapted for insertion of its inner end portion through said opening and into said cavity, means longitudinally adjustably mounting said housing on said support member, means defining a longitudinal bore in said housing, means defining a plurality of lug-mounting sockets in said inner end portion, each of said sockets communicating with said bore laterally inwardly of the socket and having a laterally outer mouth disposed to face an adjacent one of said lug-engagement surfaces when said inner end portion is in said cavity, a lug mounted in each of said sockets for reciprocal rotational movement therein between a first disposition wherein a portion of the lug protrudes laterally through the mouth of the socket into engagement with the adjacent lug-engagement surface to connect the unit to the insert, and a second disposition wherein said lug portion is withdrawn from said engagement to release the unit from the insert, actuating means longitudinally movably mounted in said bore for reciprocation between first and second positions to engage said lugs and rotate them correspondingly between their first and second dispositions, said actuating means having first reaction surfaces disposed when in said first position between said lugs in engagement therewith and thereby providing resistance acting to prevent the lugs from being rotated out of their dispositions by load forces exerted on the lug by said insert, and seating means for each lug included in said socket-defining means and providing a second reaction surface facing in a direction toward said external surface of the body and engaging the lug for transferring to said housing load forces exerted on the lug by said insert.

13. A combination as defined in claim 12 and wherein said socket-defining means additionally includes a third reaction surface facing oppositely to said second reaction surface in each socket and engaging the lug mounted in the socket, said third reaction surfaces providing additional resistance acting to prevent the lugs from being rotated out of their first dispositions by load forces exerted on the lugs by said insert.

14. In a combination of an anchor insert which includes a concrete-excluding hollow cage having an open end and a closed end, and a pair of spaced apart anchor rods mounted on said cage and each having a lug-engagement surface spaced from and facing in the direction of said closed end and engageable from the interior of the cage, said insert being adapted for embedment in a concrete body with said open end facing an external surface of the body and communicating with an opening therein, and a pickup unit releasably connectable to said insert and which includes a support member adapted to be mounted on said external surface adjacent to said opening, and lifting means connected to said support member, the improvement comprising:

a housing included in said pickup unit and having an inner end portion and an outer end portion and extending longitudinally therebetween, said housing being adapted for insertion of its inner end portion through said opening and into said cage, means longitudinally adjustably mounting said housing on said support member, means defining a longitudinal bore in said housing, means defining a pair of lug-mounting sockets in said inner end portion, each of said sockets communicating with said bore laterally inwardly of the socket and having a laterally outer mouth disposed to face an adjacent one of said lug-engagement surfaces when said inner end portion is in said cage, a lug mounted in each of said sockets for reciprocal rotational movement therein between a first disposition wherein a portion of the lug protrudes laterally through the mouth of the socket into engagement with the adjacent lug-engagement surface to connect the unit to the insert, and a second disposition wherein said lug portion is withdrawn from said engagement to release the unit from the insert, actuating means longitudinally movably mounted in said bore for reciprocation between first and second positions to engage said lugs and rotate them correspondingly between their first and second dispositions, said actuating means having first reaction surfaces disposed when in said first position between said lugs in engagement therewith and thereby providing resistance acting to prevent the lugs from being rotated out of their first dispositions by load forces exerted on the lug by said insert, and seating means for each lug included in said socket-defining means and providing a second reaction surface facing in a direction toward said external surface of the body and engaging the lug for transferring to said housing load forces exerted on the lug by said insert.

15. A combination as defined in claim 14 and wherein said anchor rods each have a round cross section providing its lug-engagement surface in arcuate configuration, and said lug portions each include a rod-engagement surface having an arcuate configuration complementary to said configuration of the adjacent lug-engagement surface.

16. A combination as defined in claim 14 and wherein said socket-defining means additionally includes a third reaction surface facing oppositely to said second reaction surface in each socket and engaging the lug mounted in the socket, said third reaction surfaces providing additional resistance acting to prevent the lugs from being rotated out of their first dispositions by load forces exerted on the lugs by said insert.

17. A combination as defined in claim 16 and wherein said anchor rods each have a round cross section providing its lug-engagement surface in arcuate configuration, and said lug portions each include a rod-engagement surface having an arcuate configuration complementary to said configuration of the adjacent lug-engagement surface.

18. A combination as defined in claim 16 and wherein each of said lugs includes means providing cam surfaces extending laterally inwardly of the rotational axis of the lug, and said actuating means includes a head member provided with said first reaction surfaces and also with a contact surface for each of said cam surfaces, said contact surfaces acting upon the cam surfaces of each lug to rotate the lug alternately from the first to the second disposition thereof and vice versa upon corresponding movement of the actuating means, said first reaction surfaces moving into said engagement with the lugs with overtravel following said contact surface action to rotate the lugs into their first disposition.

19. A pickup unit as defined in claim 18 and wherein said lugs abut on each other in said second disposition thereof to limit their rotation, whereby the lugs are disposed completely within their sockets.

20. A pickup unit as defined in claim 18 and wherein said anchor rods are mounted on a wall of said cage and separated from the interior of the cage thereby, said anchor rods each have a round cross section providing its lug-engagement surface in arcuate configuration, and said lug portions each include a rod-engagement surface having an arcuate configuration complementary to said configuration of the adjacent lug-engagement surface.

21. Apparatus as defined in claim 1 and including an ejector having reaction means connected to said housing, plunger means adapted to bear on said object, said reaction means being movable relative to said plunger means, biasing means interposed between said reaction means and said plunger means and tending to move the reaction means outwardly relative to the plunger means for ejecting said housing from said object, and means for releasably locking said ejector to prevent said relative movement.

22. Apparatus as defined in claim 21 and wherein said reaction means comprises a casing housing said plunger means and said biasing means, and said locking means comprises manually operable coupling means connected to said plunger and releasably connectable to said casing.

* * * * *